US005626015A

United States Patent [19]

Chung

[11] Patent Number: 5,626,015

[45] Date of Patent: May 6, 1997

[54] DELIVERY CONTROL DEVICE FOR HYDRAULIC PUMPS AND HYDRAULIC SYSTEMS WITH SUCH DEVICES

[75] Inventor: Dae S. Chung, Pusan, Rep. of Korea

[73] Assignee: Samsung Heavy Industries Co., Ltd., Seoul, Rep. of Korea

[21] Appl. No.: 500,724

[22] Filed: Jul. 11, 1995

[30] Foreign Application Priority Data

Sep. 30, 1994 [KR] Rep. of Korea ..... 94-25148

[51] Int. Cl.[6] ..... F16D 31/02

[52] U.S. Cl. ..... 60/450; 60/452

[58] Field of Search ..... 60/450, 452, 445

[56] References Cited

U.S. PATENT DOCUMENTS 4,420,937 12/1983 Naruse et al. ..... 60/450

4,468,173 8/1984 Dantlgraber ..... 60/452 X 5,101,628 4/1992 Yoshino ..... 60/452 X 5,277,027 1/1994 Aoyagi et al. ..... 60/452 X

*Primary Examiner*—Hoang Nguyen

*Attorney, Agent, or Firm*—Kenyon & Kenyon

[57] ABSTRACT

A delivery control device for hydraulic pumps suitable for controlling the pump delivery such that the pump's delivery characteristics are not influenced by load acting on actuators is disclosed. The device also reduces the pump delivery in cases where no actuator is being operated but instantly increases the pump delivery in the event either actuator is operated. The device has a branch line branched from a pilot line and adapted for draining the swash plate's regulating pilot oil from the pilot line to a return tank, and a relief valve provided in the branch line, selectively opened in response to a preset pressure applied thereto. The preset pressure for opening the relief valve is the delivery pressure of the hydraulic pump.

3 Claims, 2 Drawing Sheets

DELIVERY CONTROL DEVICE FOR HYDRAULIC PUMPS AND HYDRAULIC SYSTEMS WITH SUCH DEVICES

BACKGROUND OF THE INVENTION

1. Field of the Invention

The present invention relates in general to a delivery control device for variable displacement hydraulic pumps for negative type delivery controlling hydraulic systems and, more particularly, to a structural improvement in such delivery control devices for instantly increasing the pump delivery in response to starting the actuator, the invention also relates to hydraulic systems having such delivery control devices.

2. Description of the Prior Art

"Negative type controls for hydraulic pump delivery" generally means that the delivery of the hydraulic pump is controlled in such a manner that the delivery can be reduced by regulating a swash plate or by increasing the inclination angle of the swash plate using a given pilot pressure under the condition that the hydraulic pump is preset to output the maximum pump delivery in the initial state of the pump.

With reference to FIG. 1, there is shown in a block diagram a typical hydraulic system whose pump delivery is controlled using the negative type. As shown in the drawing, the system includes a plurality of directional control valves 1, 2 and 3, which are connected to a variable displacement hydraulic pump P through a common center bypass line 11 in order for letting a plurality of actuators A, B and C be operated by the pressurized fluid of pump P. In the above hydraulic system, the pump delivery or the pressurized fluid of pump P is drained to a return tank T by way of an orifice 12 when all control valves 1, 2 and 3 are in their neutral positions, or when neither of the actuators A, B and C are operated. The center bypass line 11, after passing the control valves 1, 2 and 3, is branched to a pilot line 13, which is used for supplying pilot pressure Pi to pump P to regulate the inclination angle of the swash plate of pump P. In the above hydraulic system, pump P is preset to output maximum pump delivery in the initial state of pump P. When the pilot pressure Pi acts on the swash plate of pump P, the inclination angle of the swash plate is regulated or increased in proportion to the pilot pressure Pi so that the delivery of pump P is reduced. In the above block diagram, reference symbol Qp denotes a pressurized fluid flow or the delivery of pump P measured at the point "a" of the bypass line 11, while the reference symbol Qn denotes a pressurized fluid flow, after passing control valves 1, 2 and 3, measured at point "b" of line 11.

The relation between the pressure Pi and the fluid flow Qn and the relation between the pressure Pi and the fluid flow Qp in the above hydraulic system are represented by the graphs of FIGS. 2A and 2B respectively.

As represented in the graphs of FIGS. 2A and 2B, the pilot pressure Pi is in proportion to the fluid flow Qn and this makes the fluid flow Qp be in inverse proportion to the pilot pressure Pi. Otherwise stated, when all of the control valves 1, 2 and 3 are in their neutral positions, or when neither of the actuators A, B and C are being operated, the fluid flow Qn is maximized, that is, Qn=Qp. In this case, the pilot pressure Pi is increased due to the negative pressure generated by the pressurized fluid passing the orifice 12.

The inclination angle of the swash plate of the pump P thus varies by the increased pilot pressure Pi so that the pump delivery Qp is reduced. On the other hand, when at least one of the above actuators A, B and C is operated, the pump delivery Qp is partially applied to the operated actuator so that the fluid flow Qn becomes the fluid flow resulting from subtracting the fluid flow for the operated actuator from the pump delivery Qp. Such reduction of the fluid flow due to fluid consumption by the operated actuator makes the pilot pressure Pi be proportionally reduced so that pump delivery Qp is increased.

That is, the pump delivery of the above hydraulic system will be automatically reduced when there is no operated actuator. However, the pump delivery will be automatically increased when at least one actuator is operated.

However, the above hydraulic system has a problem that the pump delivery Qp is not instantly increased in response to the start of the actuator, but slowly increased after some retardation.

The above problem is noted to be caused by the fact that the system is not in an ON/OFF state, in which the ON/OFF state of valves 1, 2 and 3 are completely opened or closed, but in a transitional state, in which each control valve is partially opened or closed, due to the spool strokes of the valves 1, 2 and 3. As shown in FIG. 3, the transitional state of the valves 1, 2 and 3 means that the internal lines, that is, the bypass line 11, an actuator fluid supply line 14 and an actuator fluid return line 15, of the control valves form orifices respectively. When the actuators A, B and C are applied with a load (higher than the load applied thereto when the pressurized fluid of the pump P passes the orifice 12) during the above transitional state, the pump delivery Qp does not flow in the actuator fluid supply line 14 but totally flows in the bypass line 11 with a relatively lower load. Therefore, both the fluid flow Qn and the pilot pressure Pi are not even slightly increased irrespective of the start of the actuator and the pump delivery Qp is not increased at all. This means that the pump delivery characteristic of the typical hydraulic system is changed by the load acting on actuators A, B and C.

If briefly described, the typical hydraulic system whose pump delivery is controlled using the negative type has a problem that the pump delivery can not help being slowly increased after some retardation for achieving sufficient spool stroke of a control valve even though it is preferred to instantly increase the pump delivery in response to starting the actuator.

SUMMARY OF THE INVENTION

It is, therefore, an object of the present invention to provide a pump delivery control device for hydraulic systems of the negative type in which the above problems can be overcome and which controls the pump's delivery such that the pump delivery characteristic is not influenced by load acting on actuators.

It is another object of the present invention to provide a pump delivery control device for hydraulic systems of the negative type which reduces the pump's delivery in cases where no actuator is being operated, but instantly increases the pump delivery in the event either actuator is operated.

It is a further object of the present invention to provide a hydraulic system having the above pump delivery control system.

In order to accomplish the above objects, an embodiment of the present invention provides a delivery control device for hydraulic pumps comprising: a branch line branched from a pilot line and adapted for draining the swash plate's regulating pilot oil from the pilot line to a return tank; and a relief valve provided in the branch line, selectively opened in response to a preset pressure applied thereto.

In the present invention, it is preferred to let the preset pressure for opening the relief valve become the delivery pressure for the hydraulic pump.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
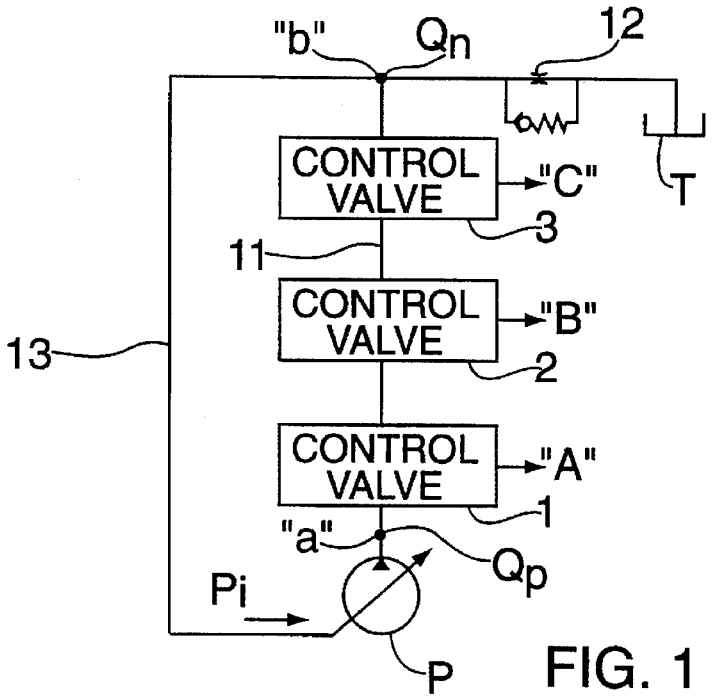
FIG. 1 is a block diagram of a typical hydraulic system in which the pump delivery is controlled using the negative type.
Figure 2A:
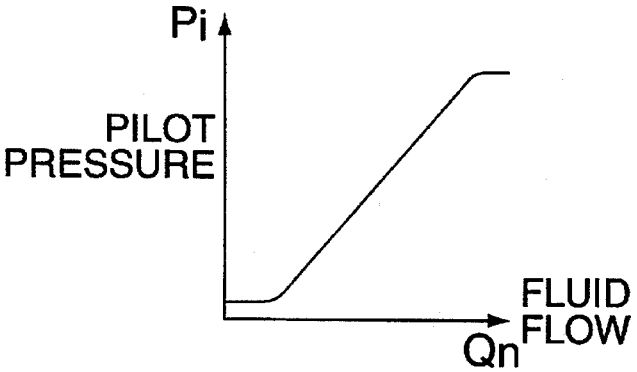
FIGS. 2A and 2B are graphs showing the relation between pilot pressure Pi and fluid flow Qn after passing directional control valves and the relation between the pilot pressure Pi and the pump delivery Qp of the hydraulic system of FIG. 1, respectively.
Figure 2B:
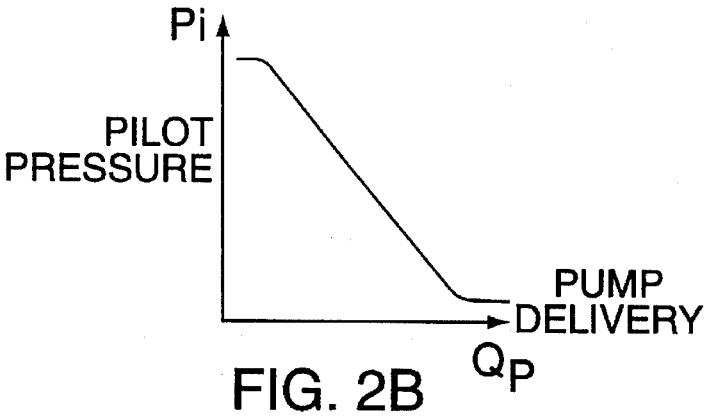
Figure 4:
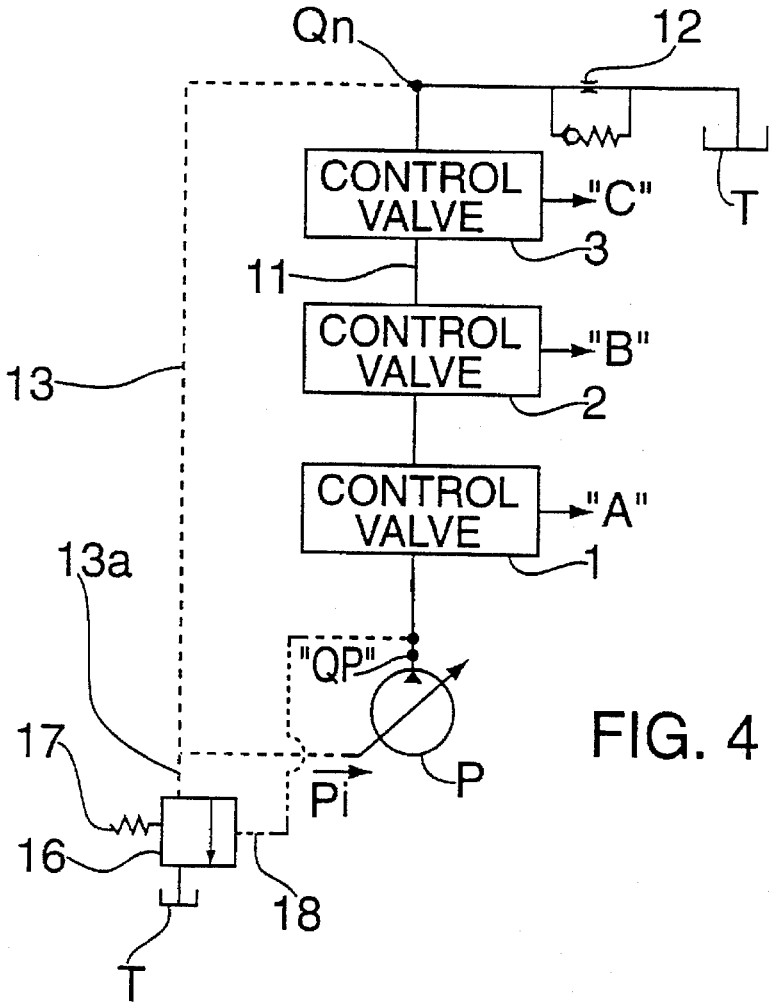
FIG. 4 is a block diagram of a hydraulic system having a pump delivery control device in accordance with an embodiment of the present invention.

With reference to FIG. 4, there is shown in a block diagram a hydraulic system having a pump delivery control device in accordance with an embodiment of the present invention. Please note that most of the elements of the instant system are common with those of the typical system of FIG. 1. Those elements common to both the instant system and the typical system will thus carry the same reference numerals and further explanation for the elements common to both systems is not necessary.

As shown in FIG. 4, the hydraulic system of the invention includes a variable displacement hydraulic pump P, a plurality of actuators A, B and C operated by pressurized fluid of the pump P and a plurality of directional control valves 1, 2 and 3 for controlling operation of the actuators A, B and C respectively. The system also includes a bypass line 11 for draining the pressurized fluid of pump P to a return tank T when all of the control valves 1, 2 and 3 are in their neutral positions, that is, when neither of the actuators A, B and C is operated. An orifice 12 is provided in the bypass line 11 between the control valves 1, 2 and 3 and the return tank T. The system further includes a pilot line 13, which is branched from the bypass line 11, after passing the control valves 1, 2 and 3, and connected to a swash plate of pump P. The pilot oil of the pilot line 13 is supplied for regulating the swash plate of pump P. The above elements of the instant system are the same as those of the typical system of FIG. 1.

In order to provide the pump delivery control device of the present invention, a branch line 13*a* is provided as branched off from the pilot line 13 and connected to the return tank T. A part of the pilot oil of the pilot line 13 may be drained to return tank T through the branch line 13*a* selectively.

A relief valve 16 is provided in the branch line 13*a*. The relief valve 16 is preset to be normally closed by a pressure setting spring 17. A hydraulic line 18 may be provided, which extends from the pump P to the relief valve 16 in order to control opening or closing of the relief valve 16. When the delivery pressure of the pump P is higher than a preset pressure of the spring 17, the valve 16 is opened so as to drain a part of the pilot oil of the pilot line 13 to the return tank T. As the hydraulic line 18 is branched off from the bypass line 11 at a position upstream of the directional control valves 1,2,3 and extends to the relief valve 16, the preset pressure for opening the relief valve 16 is equal to the pump delivery pressure of pump P.

In the pump delivery control device of this invention, the fluid flow Qn of the system will be maximized or equal to the pump delivery (Qn=Qp) when all of the control valves 1, 2 and 3 are in their neutral positions, that is, when any of the actuators A, B and C are being operated. In this case, the pilot pressure Pi is increased due to the negative pressure generated by the pressurized fluid passing the orifice 12. The inclination angle of the swash plate of pump P thus varies due to the increased pilot pressure Pi so that the pump delivery Qp is reduced. As the pump delivery Qp is either stable or reduced in this case, the relief valve 16 is closed so that no pilot oil the pilot line 13 is drained to return tank T.

Figure 3:
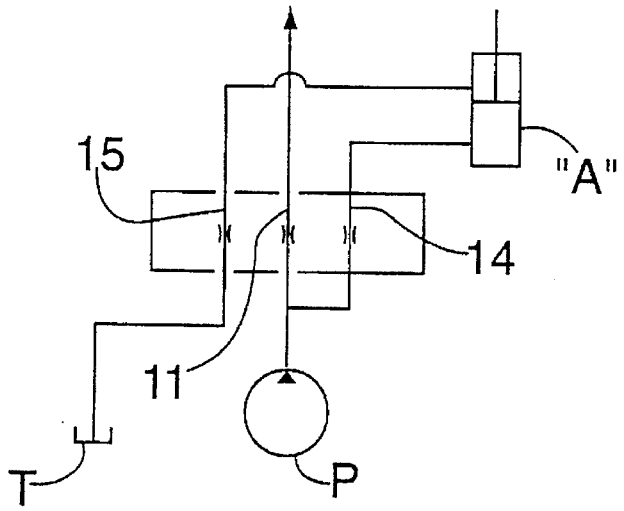
FIG. 3 is a block diagram of a part of the hydraulic system of FIG. 1, showing conditions of internal hydraulic lines of a directional control valve in a transitional state.

In a transitional state in which either of actuators A, B and C is started, there will be formed orifices in the internal lines 11, 14 and 15 of a directional control valve as all of the internal lines are partially opened as shown in FIG. 3. Due to the orifices formed in the internal lines, the pump delivery pressure is increased. The increased delivery pressure is applied to the relief valve 16 through the line 18 and thereby opening the valve 16. When the valve 16 is opened, a part of the pilot oil of the pilot line 13 is drained to return tank T through the line 13*a* so that the pilot pressure Pi is reduced but the pump delivery Qp is increased.

When the spool of at least one of the control valves 1, 2 and 3 fully moves to its full stroke, the bypass line 11 in the control valve is fully closed while both the actuator fluid supply line 14 and the actuator fluid return line 15 of the control valve are fully opened. In this case, the pump delivery Qp is partially applied to the operated actuator so that the fluid flow Qn becomes the fluid flow resulting from subtracting the fluid flow for the operated actuator from the pump delivery Qp. Such reduction of the fluid flow due to fluid consumption by the operated actuator makes the pilot pressure Pi be proportionally reduced and this makes the pump delivery Qp be increased.

As described above, the present invention provides a pump delivery control device for hydraulic systems of the negative type, which controls the pump delivery such that the pump delivery characteristic is not influenced by load acting on actuators. The control device also reduces the pump delivery in cases where no actuator is being operated but instantly increases the pump delivery in the event either actuator is operated. The control device thus remarkably improves operational responsibility of the hydraulic system in the event actuators are started.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hydraulic system comprising:

a variable displacement hydraulic pump;

at least one actuator operated by pressurized fluid of the pump;

at least one directional control valve arranged between said pump and a return tank and adapted for controlling operation of said actuator;

a bypass line extending from said pump to said return tank such that the bypass line passes the directional control valve, said bypass line being adapted for draining the pressurized fluid of the pump to said return tank when said directional control valve is in the neutral position;

an orifice provided in said bypass line between said control valve and said return tank;

a pilot line branched from said bypass line after passing said control valve, said pilot line being adapted for selectively supplying the swash plate's regulating pilot oil to said pump;

a branch line branched from said pilot line and adapted for draining said swash plate regulating pilot oil of the pilot line to said return tank; and a relief valve provided in said branch line and selectively opened in response to a preset pressure applied thereto.

2. The hydraulic system according to claim 1, wherein said relief valve is closed by a pressure setting spring and opened by a delivery pressure from said pump.

3. The hydraulic system according to claim 1, further comprising a hydraulic line extending between the pump and the relief valve, said hydraulic line being adapted for letting the relief valve be closed by a pressure setting spring and opened by a delivery pressure from said pump.

* * * * *